US009211938B1

(12) United States Patent
Cardarelli et al.

(10) Patent No.: US 9,211,938 B1
(45) Date of Patent: Dec. 15, 2015

(54) DUAL ROD MOORING PENDANT APPARATUS

(71) Applicants: Venanzio Cardarelli, Plymouth, MA (US); Ronald A Wolf, Plymouth, MA (US)

(72) Inventors: Venanzio Cardarelli, Plymouth, MA (US); Ronald A Wolf, Plymouth, MA (US)

( * ) Notice: Subject to any disclaimer, the term of this patent is extended or adjusted under 35 U.S.C. 154(b) by 92 days.

(21) Appl. No.: 13/998,322

(22) Filed: Oct. 21, 2013

(51) Int. Cl.

| | |
|---|---|
| ***B63G 7/04*** | (2006.01) |
| ***B66F 19/00*** | (2006.01) |
| ***B63B 21/04*** | (2006.01) |
| ***B63B 21/54*** | (2006.01) |

(52) U.S. Cl.
CPC ..... *B63B 21/04* (2013.01); *B63B 21/54* (2013.01)

(58) Field of Classification Search
CPC .. B63B 21/00; B63B 2021/001; B63B 21/54; B63B 21/04
USPC ..... 114/230.1, 230.15, 230.16, 230.17, 114/230.18, 230.19, 230.25, 230.2, 6, 114/221 R; 294/175, 191, 209
See application file for complete search history.

(56) References Cited

U.S. PATENT DOCUMENTS

| | | | | |
|---|---|---|---|---|
| 653,021 | A | 7/1900 | Hamilton | |
| 2,246,630 | A | 6/1941 | Johnson | |
| 2,492,991 | A | 1/1950 | Hanna | |
| 4,595,223 | A * | 6/1986 | Hawie | 294/175 |
| 4,817,551 | A | 4/1989 | Matson | |
| 5,365,688 | A * | 11/1994 | Yong-Set | 43/5 |
| 5,381,749 | A | 1/1995 | Larson | |
| 5,398,634 | A | 3/1995 | Eagan | |
| 5,538,303 | A | 7/1996 | Dunham | |
| 5,634,421 | A | 6/1997 | Velarde | |
| 5,820,181 | A | 10/1998 | LeNoach | |
| 6,085,681 | A * | 7/2000 | Morton | 114/221 R |
| 6,273,017 | B1 | 8/2001 | Griffin | |
| 6,363,876 | B1 * | 4/2002 | Blake | 114/230.1 |
| 6,390,009 | B2 | 5/2002 | Brown et al. | |
| 6,450,558 | B1 | 9/2002 | Ringrose | |
| 6,772,488 | B1 | 8/2004 | Jensen et al. | |
| 7,089,877 | B1 | 8/2006 | Hay | |
| 7,096,813 | B1 | 8/2006 | Luck | |
| 7,712,804 | B2 | 5/2010 | Leyden et al. | |
| 7,757,360 | B1 | 7/2010 | Hong | |
| 2008/0156245 | A1 * | 7/2008 | Duarte et al. | 114/230.15 |

FOREIGN PATENT DOCUMENTS

| | | | | |
|---|---|---|---|---|
| EP | 0644340 | A2 * | 9/1994 | B36B 21/54 |

* cited by examiner

*Primary Examiner* — S. Joseph Morano
*Assistant Examiner* — Andrew Polay
(74) *Attorney, Agent, or Firm* — D. Michael Burns

(57) ABSTRACT

A dual rod apparatus for coupling and decoupling of attachment hooks to facilitate the mooring of a boat. The apparatus comprises an attachment front end which includes a hook, a hook attachment base connected onto the hook by a wedge. The hook attachment base having a pair of pull line apertures and a pair of rod channels. The apparatus includes a pair of rods, a pair of pull lines. A fixed guide provides stability for the rods and pull lines. A handle controls the apparatus. A slide is positioned between the guide and handle and opens the hook when the slide is pulled with sufficient force to overcome locking tensions placed by the hook.

13 Claims, 9 Drawing Sheets

DUAL ROD MOORING PENDANT APPARATUS

CROSS-REFERENCE TO RELATED APPLICATIONS

This application relates to Provisional U.S. Application No. 61/795,791, on Oct. 26, 2012, for a Dual Rod Pendant Apparatus, the disclosure of which is incorporated by reference herein in its entirety.

FIELD OF THE INVENTION

This invention relates to a dual rod apparatus for coupling and decoupling of attachment hooks to facilitate the mooring of a boat. More specifically, the apparatus allows for easier attachment of a mooring line to the bow of a boat while using a dual rod handle.

BACKGROUND OF THE INVENTION

Pleasure boats, such as yachts and small boats, are often moored to either a dock rail or a mooring buoy. The mooring line is tied around the dock rail or through a mooring ring on a buoy. Preferably the mooring line is tied to a ring or eye member that is found on the bow of the boat. Because of the difficulty in securing a mooring rope to a relatively remote eye member, such as one found on the bow of a boat, the boater often omits this procedure and only ties the boat to the cleats on the top surface of the boat. The difficulty created in trying to tie the rope to the buoy ring may be just as hard because the boater must reach down for the buoy and then often must pull it up to tie the line. If the mooring line cannot be pulled up, due to factors such as weight or tension in its anchor line, a second person is usually required. The main problem that is encountered in tying a mooring rope to the ring on the bow of a boat is usually due to the awkward position in which most bow rings are located. Reaching over and trying to reach the bow ring can be very hazardous to a boater, especially in rough waters. An unassisted boater may even find it impossible to moor his boat. It may be especially difficult to attach and detach a tie line to a mooring buoy or a boat bow ring or eyelet, in situations where a boat is not small enough to permit the user to reach down and manually fasten or unfasten the clip which secures the tie line to the mooring buoy or bow ring. Also, tying the mooring line to cleats on the deck of the boat creates chafe which can weaken and eventually cause failure of the mooring line. And, with more boats being built with pop-up or pull-up cleats there is the problem of failure from the constant stress of the mooring line. When the freeboard is large, the boater must use a long boat hook or gaff to reach down and snag the mooring line and lift it up to height where he can manually snap or unsnap the clip from the buoy or bow eye member.

Remote control attachment assemblies are commercially available and such assemblies usually comprise a slide member designed to be attached to a conventional elongated boat hook and then retain the hook in an open position. This enables the open hook to engage the eye member of the mooring buoy or bow ring. Such assemblies are often difficult to use. Previous inventions have disclosed that the type of devices which are generally considered the easiest to operate are those employing a long rod that acts as an extension of the boater's arm and then has a clip located on the end, or either end, wherein the opening and closing of the clips by remote means eases the burden of the procedure. Examples of such devices are seen in U.S. Pat. Nos. 8,443,747, 8,342,116 and 8,327,788 issued to Cardarelli et al.

SUMMARY OF THE INVENTION

The present invention improves on current devices and apparatus and provides a safe and convenient means for docking a boat to a mooring structure using a dual rod mooring pendant apparatus. The apparatus releasably couples or decouples to an eyelet on the bow of the boat or to a buoy. The apparatus includes a clip attachment front end that may open or close for attachment or release. The front end includes a hook attachment base which is connected by a wedge onto the backbone of a hook, with the hook attachment clip base having a pair of pull line apertures and a pair of rod channels defined in the base. The hook has a movable arm for opening and closing, a grasping end on the hook for receiving the movable arm, and a ring section having an opening for tying a mooring line. The wedge is connected to the hook attachment base with 1 inch truncated screws. Each truncated screw having a partially smooth shank starting from the head of the screw. A fixed guide provides stability and guidance and has a pair of mooring line guidance extensions defining an opening for passage of a mooring line, a pair of rod channels defined therein for guiding a pair of stainless steel rods, and a pair of pull line apertures for guiding a pair of pull lines. Each opposite side of the fixed guide is attached to one of the rods with a truncated set screw. The apparatus includes a slide which has a pair of rod channels defined through its body with each channel sized to allow a sliding relationship with each rod, a pair of pull line canals and apertures defined in the upper surface of the slide. The canals consist of a pair of cutout sections extending from the upper surface of the slide, each cutout having a beveled area for receiving the end of a pull line. Controlling the handling of the apparatus is a handle with a rounded construction, the handle having a pair of mooring line guidance extensions defining an opening for passage of the mooring line, with a pair of rod channels for guiding each of the rods. A boater may pull the slide with sufficient force to overcome the locking tensions placed on the movable arm, therein causing the hook to open.

DETAILED DESCRIPTION OF THE PREFERRED OF THE INVENTION

Figure 1:
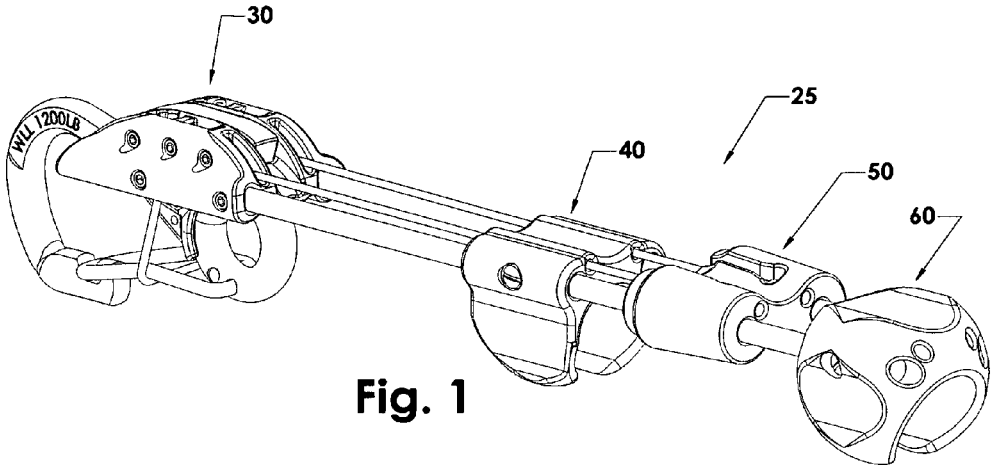
FIG. 1 is a pictorial view of a mooring pendant apparatus of the invention.
Figure 2:
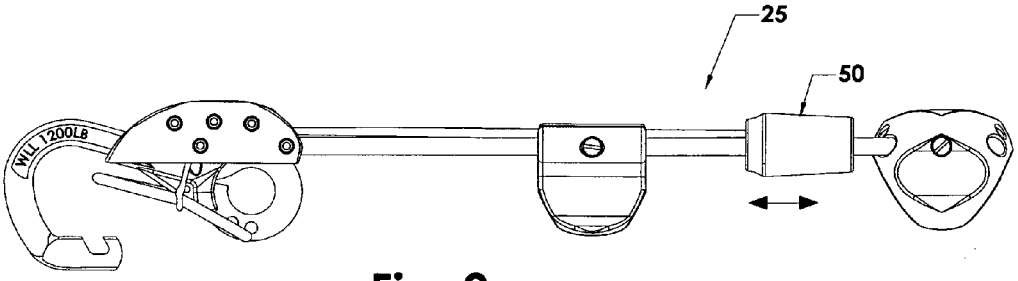
FIG. 2 is elevation side view of the invention in an open position.
Figure 3:
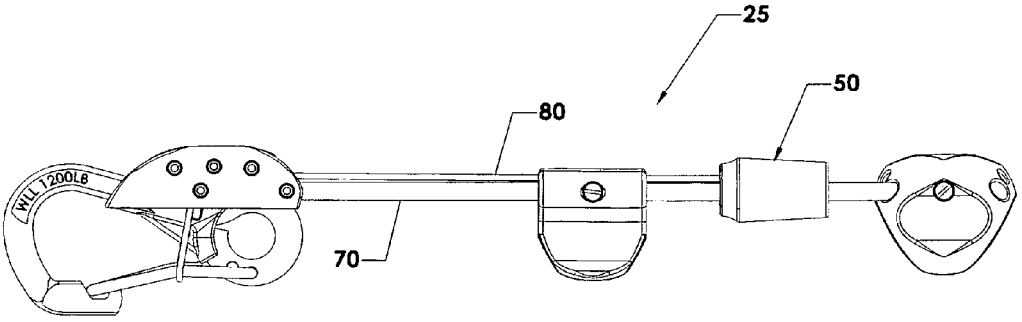
FIG. 3 is an elevation side view of the invention in a closed position.

The preferred embodiment of the invention will now be described with reference to the Figures. Some terms used in the description and the appended claims are defined below. Referring to FIGS. 1-3, the illustrated mooring pendant apparatus 25 is comprised of the following portions: an attachment front end 30; a fixed guide 40; a slide 50; a handle 60; a pair of interconnecting rods 70; and a pair of pull lines 80. Actually, the pull lines are a continuous single line that is wrapped around the movable arm. Important considerations in the design of the invention are the materials, size, length, and weight since the apparatus is subject to harsh conditions and must be used by a single boater.

Figure 4:
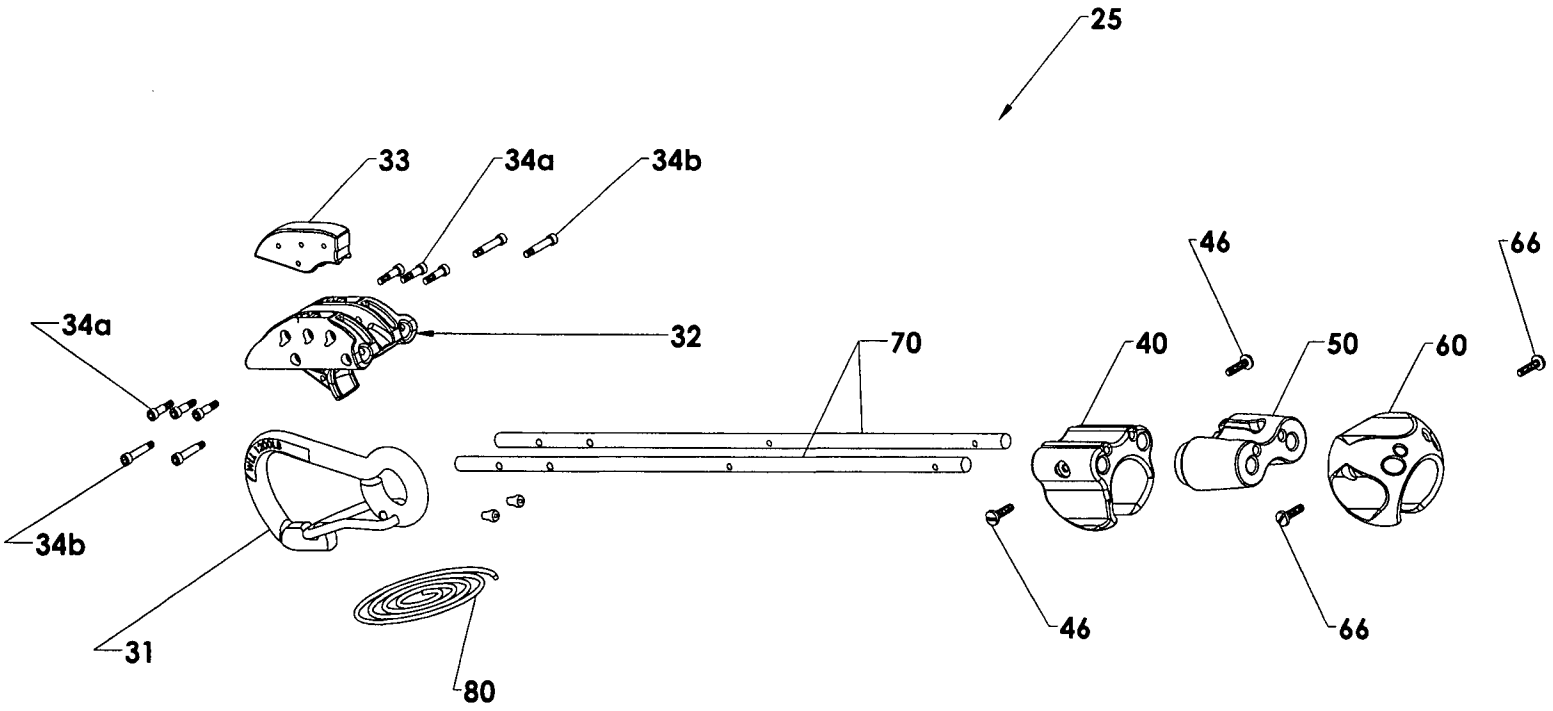
FIG. 4 is a top expanded view of the invention.
Figure 6:
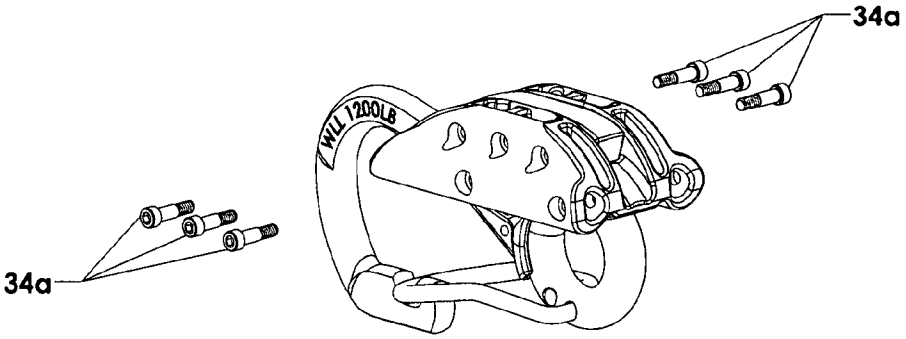
FIG. 6 is a completed unit of FIG. 5.
Figure 5:
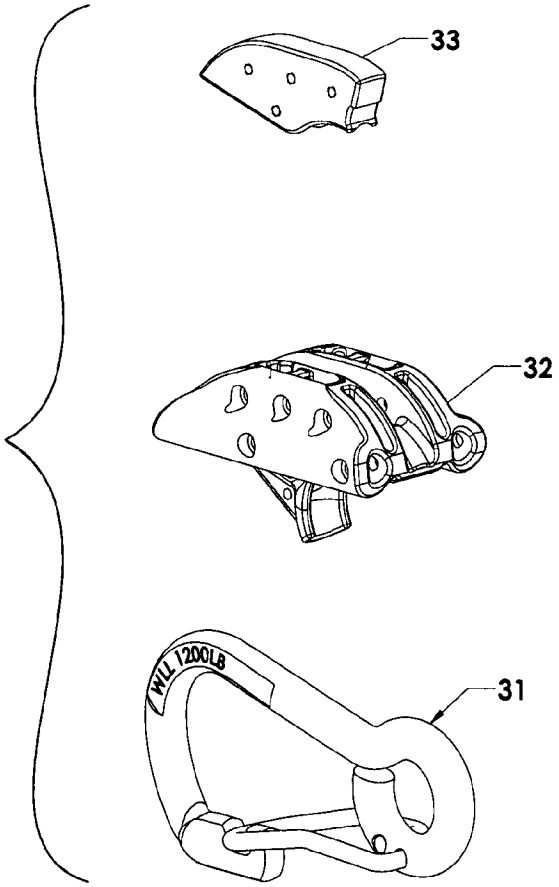
FIG. 5 is an expanded view of the hook, clip attachment base and wedge of the invention.
Figure 9:
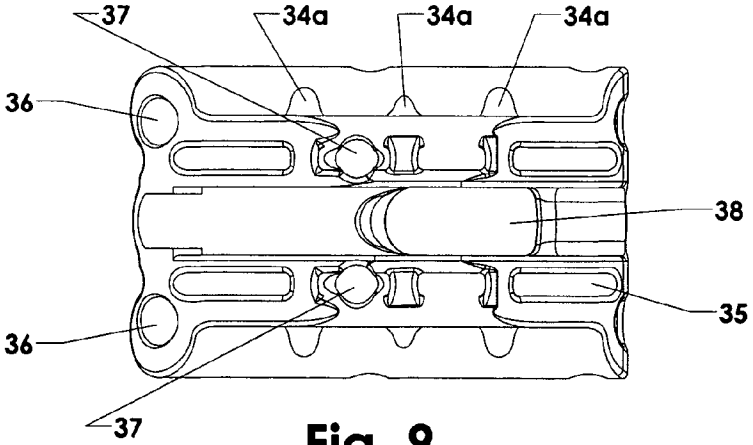
FIG. 9 is a top plane view of the clip attachment base.
Figure 7:
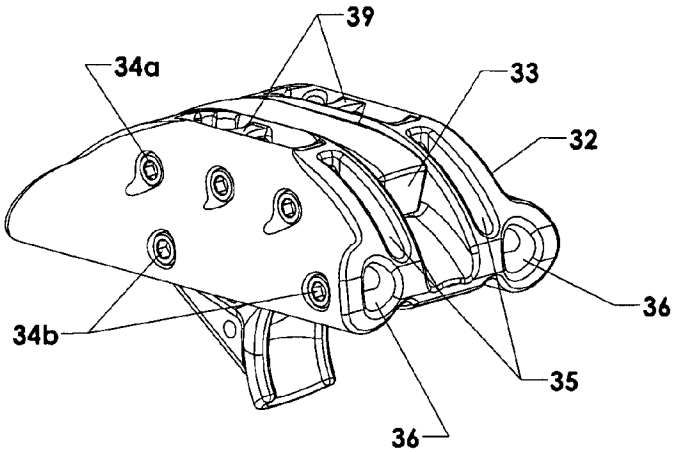
FIG. 7 is an upper pictorial view of the clip attachment base and wedge.
Figure 8:
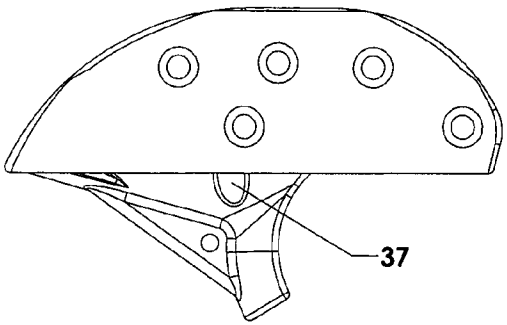
FIG. 8 is a side view of the clip attachment base.

The boat ring (found on the boat and therefore not shown here) may have several functions, but for the purpose of the present invention the focus is on its location on the boat. The boat ring is placed nearer to the water to lower its' center of gravity and rotation, therefore using the boat's framework to reduce and handle the stresses. The design and location of the boat ring, usually an eyelet, were carefully engineered for this function and not convenience, therefore the boat ring is often in a very precarious place to reach. The design of the apparatus 25 is to facilitate the ease of placement and removal of a mooring line to a boat ring so as to properly secure the vessel in the water. The dual rod feature of this mooring ring apparatus 25 is an improvement of existing mooring pendant apparatus in that a boater may easily install it onto a standard hook 31 as seen in FIGS. 4 to 6. One consideration of importance is that the apparatus 25 must have good weight distribution and not be bulky or interfere with the ease of use. Good weight distribution will limit the rotation of the unit which is important for proper functionality of the hook, mooring line, and pull lines.

Figure 18:
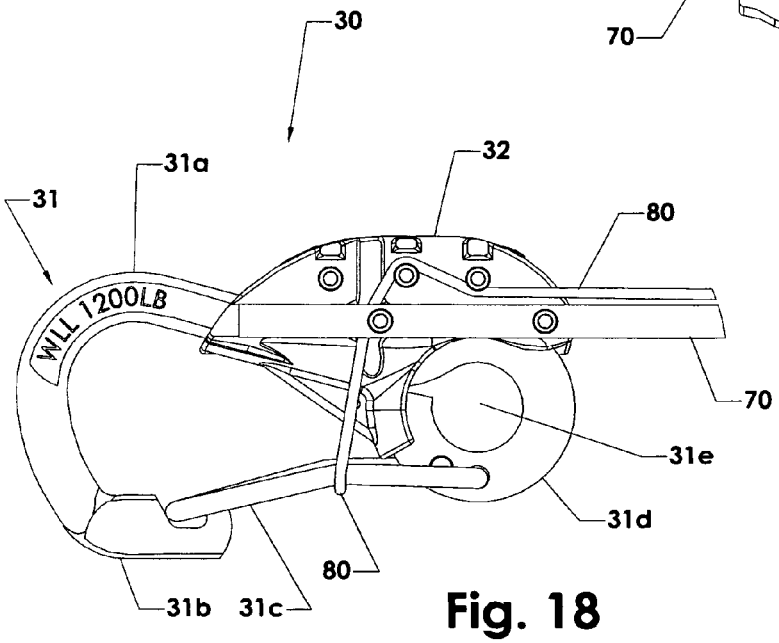
FIG. 18 is a detail of the path of a pull line around the clip attachment base.

As best seen on FIGS. 5, 6, and 18, the hook attachment base 32 is designed to be slipped over the ring section 31*d* of the hook 31, and placed into position and affixed to the backbone 31*a* of the hook 31, such that the active part of the hook, which is the movable arm 31*c*, is free to open and close. A wedge 33 secures the hook attachment base 32 and hook 31 with 1 inch truncated screws 34*a*. The movable arm 31*c* is so shaped by design and placement within holes in the ring section 31*d* of the hook that a spring action is created that will cause the arm to be in a closed position within the grasping section 31*b* of the hook when not activated by the boater. The backbone of the hook 31*a* is above the mooring line connectivity ring 31*d*, and angulated slightly to it. It is this section of the hook 31 which encompasses the bow ring of the boat. The open area 31*e* of the ring 31*d* of the hook houses the mooring line (not shown) and is designed to offer good anti-rotational stability while not causing any chafing or interference with function.

As best shown in FIGS. 7-9, 17 and 18, the attachment front end 30 consists of the hook attachment clip base 32 which is designed and configured to be connected onto the backbone 31*a* of the hook 31 and secured by a wedge 33 with a plurality (preferably six) of 1 inch truncated screws 34*a* affixing the wedge into the unit. Each truncated screw having a partially unthreaded smooth shank below its head. A hook access hole 38 in the hook attachment base 32 provides a seat for placement onto the ring section of the hook. The hook attachment base 32 has an access hole 37 for access to the pull lines. A pair of rods 70 emanate from rod channels 36 in the hook attachment base 32 through the fixed guide 40 through the slide 50 and terminate in the handle 60. Each of these rods 70 is connected to the attachment front end 30 by a pair of 1.25 inch truncated screws 34*b* positioned on opposing sides of the base as seen on FIGS. 7 and 17. Each of the 1.25 inch screws having a partially unthreaded smooth shank surface. The attachment front end 30 provides the framework and mechanism to guide the pull lines 70. To do this the attachment base 32 has a pair of pull line slots 35 that extend through it for receiving the pull lines 80 and guiding them around the smooth sections of the truncated screws 34*a* (beneath one of the screws and over the next one) and around the smooth section of one of the truncated screws 34*b* connecting a rod 70 to the base 32 before wrapping around the movable arm 31*c*. The path of the pull lines is best seen on FIG. 18. The smooth surface of the screws minimizes chafing of the pull lines. A plurality of retainers 39 in the upper area of the hook attachment base 32 keep the pull lines in place. When activated by pulling back on the slide 50, the pull lines 80 are guided through the fixed guide 40 to the hook attachment base 32, and then around the smooth section of the truncated screws 34*a* which causes an alteration in the direction of pull, through the underside of the base 32 and around the movable arm 31*c*. The pull lines are actually one continuous unit which wrap around the movable arm to create the two lines.

The weight distribution must be taken into account, regardless of the materials chosen. It is suggested that the preferred embodiment, 316 stainless steel be used for the rods and thermoplastics for the hook attachment base 32, fixed guide 40, slide 50 and handle 60. The hook attachment base 32 may be of metal or a thermoplastic material. The truncated screws are stainless steel and the smooth partially unthreaded surface is similar to that seen in lag or wood screws.

Figure 10:
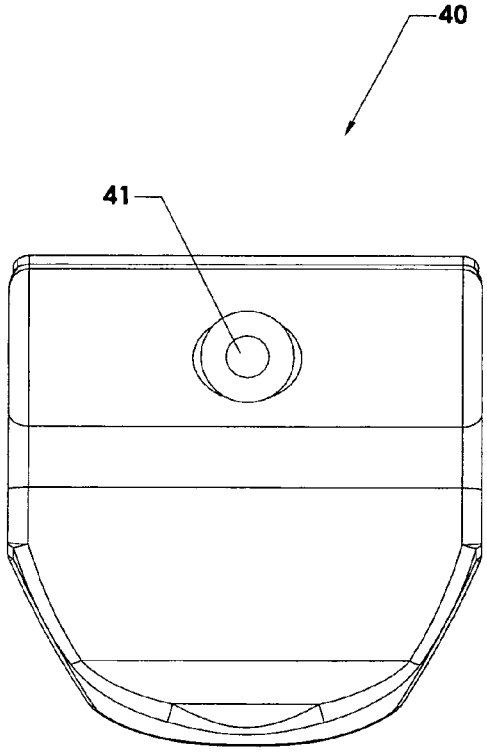
FIG. 10 is a side view of a fixed guide.
Figure 11:
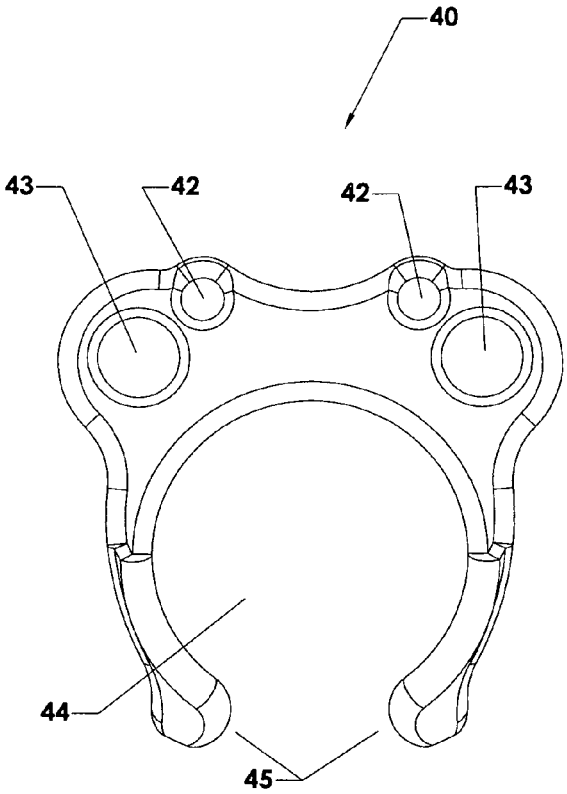
FIG. 11 is an end view of the fixed guide of FIG. 1

The fixed guide 40, as shown in FIGS. 10 and 11 has a pair of mooring line guidance extensions 45 extending downward on both sides to engage and guide the mooring line. These guidance extensions 45 are curved in design so as to provide a confined area 44 to control the mooring line close to the apparatus. The fixed guide 40 has a pair of guide apertures 42 to allow for the guidance and passage through of the pull lines 80. The fixed guide 40 also has a pair of guide rod channels 43 defined therein for the accommodation of the rods 70, thereby providing stability of each rod to the other. The fixed guide 40 is connected on both sides of the guide to a rod 70 by a screw 46 affixed into threaded hole 41. The fixed guide provides a measure of control for the pull lines 80 and stability for the rods 70. The placement of the fixed guide 40 relative to the slide 50 is critical. In an at rest position, (when the pull lines 80 are passive) the movable arm 31*c* is in a closed position. The fixed guide 40 also limits the forward movement of the slide 50. If it did not, then there could be some slack in the lines thereby altering the orientation of the pull lines on the movable arm 31*c*. The handle 60 also provides a limit on the pull of the slide 40. The distance the slide 50 travels affects proper function by being equivalent to the full retraction of the movable arm 31*c* of the hook. An important aspect is that the pull line must have little or no elongation or stretch. There should be a controlled elongation in a harsh watery salt environment with the added effects of sun and drying. While the fixed guide 40 may be metal, the preferred material of construction is a thermoplastic that will tolerate heat, cold and be dimensionally stable in harsh environments.

Figure 13:
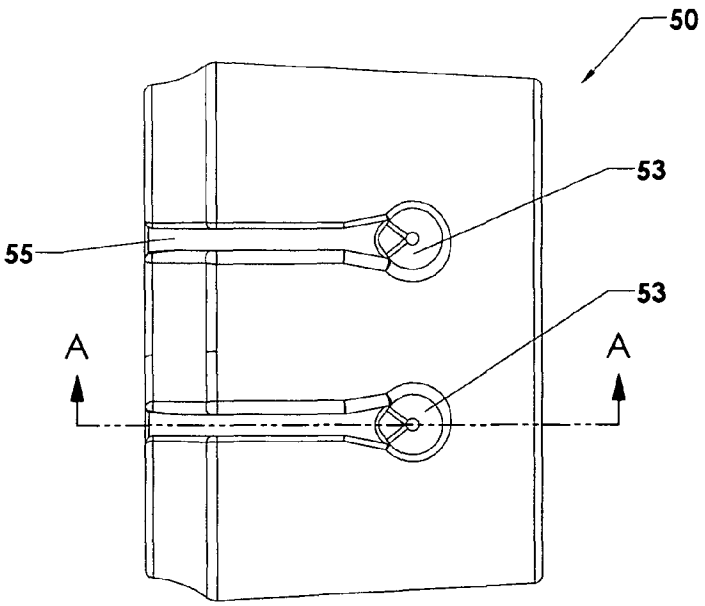
FIG. 13 is a top view of the slide of FIG. 1.
Figure 14:
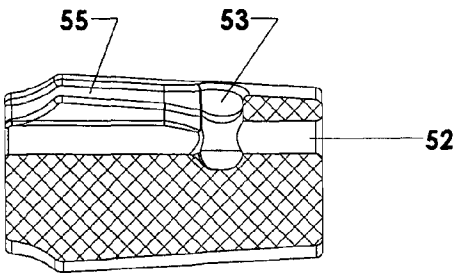
FIG. 14 is a cross-section view taken along A-A of FIG. 13.
Figure 12:
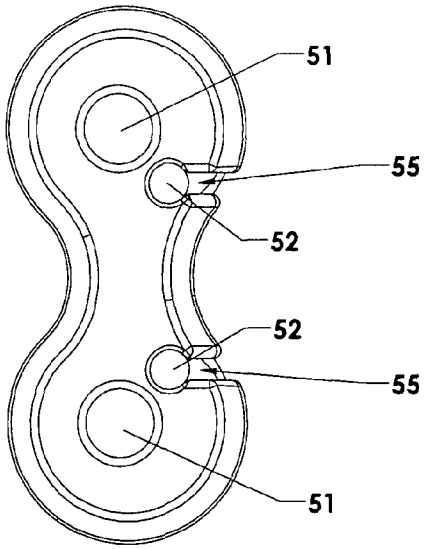
FIG. 12 is an end view of the slide.

The slide 50, FIGS. 12-14, houses both of the pull lines 80 and has a pair of slide rod channels 51 for passage of the rods 70. The slide 50 does not directly engage the mooring rope, and is free to slide without resistance. The diameter of the slide rod channels 51 are slightly larger in diameter than the rods 70 to allow the slide to move freely. As seen in FIGS. 13 and 14, the pull line apertures 52 are defined all the way through the slide 50. That is to allow other possible variations of the pull line. The present invention utilizes a design wherein canals 55 are cut into the top surface of the slide 50 therein leaving direct open access to a portion of the pull line apertures 52. The pull line 80 has its' distal ends inserted into fasteners, which are then crimped to retain the pair of pull lines to create a crimped fastener 81 which is placed directly through the top of the slide into a beveled area 53 at the distal end of the canal 55. This securely fastens the pull lines to the slide. By pulling back on the slide 50 the boater may pull on the pull lines thereby opening or closing the movable arm 31*c* of the hook 31 to allow engagement or release of the apparatus from the bow ring of the boat. Although metal may be used, preferably, the slide is made of a thermoplastic material suitable for the harsh conditions.

Figure 16:
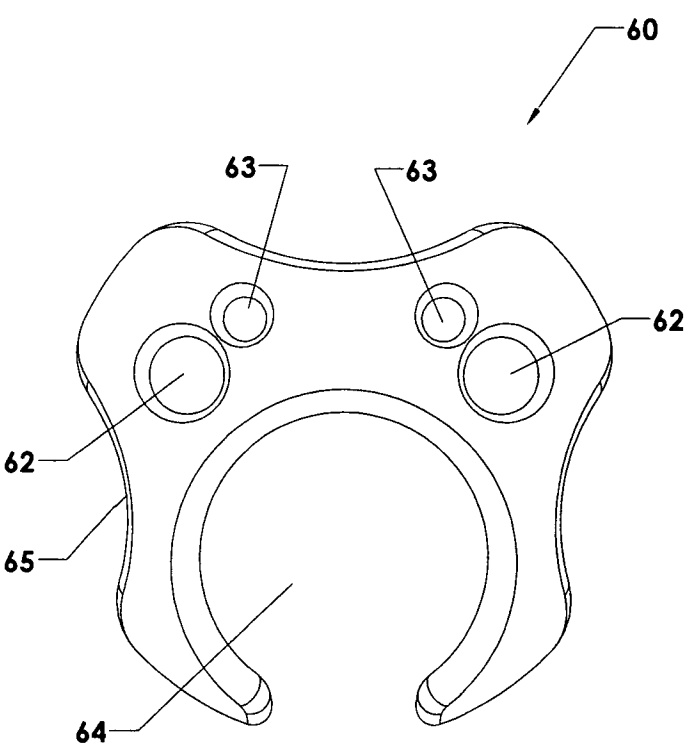
FIG. 16 is an end view of the handle.
Figure 15:
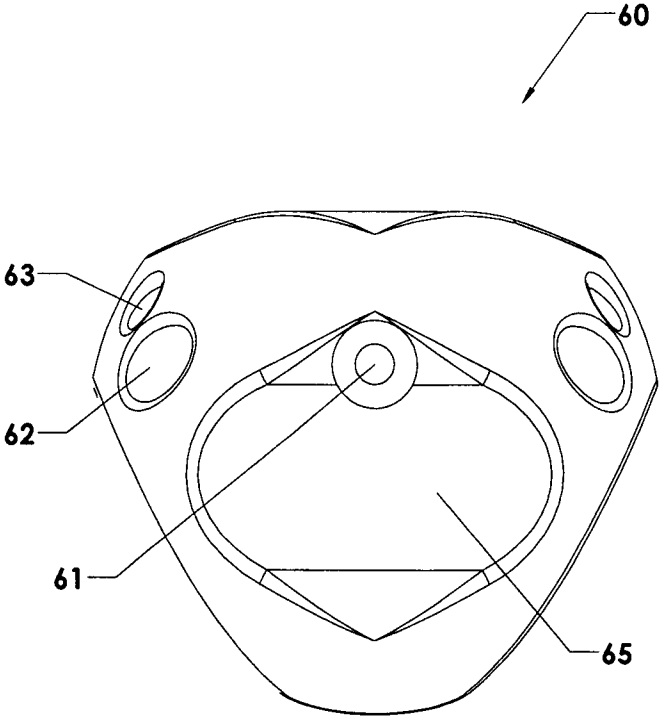
FIG. 15 is an elevated side view of the handle of the invention.
Figure 17:
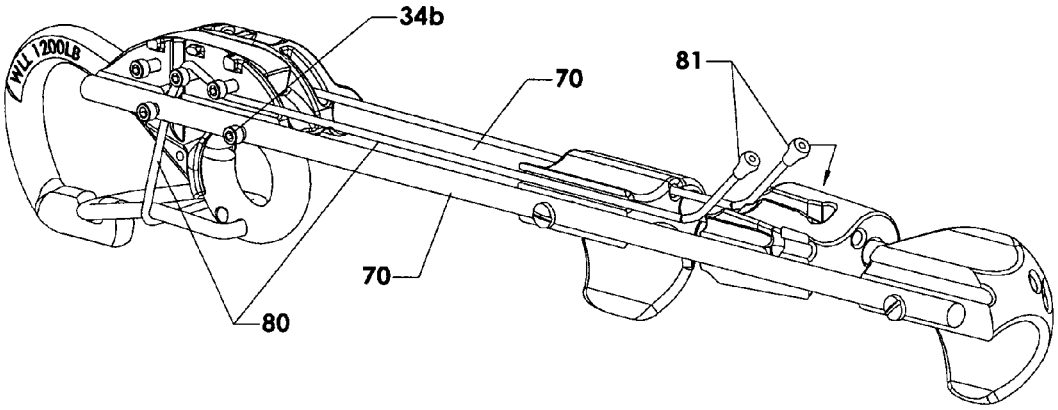
FIG. 17 is a cut-out view of the invention showing the pull lines and their crimp ends as they are seated in the slide.
Figure 19:
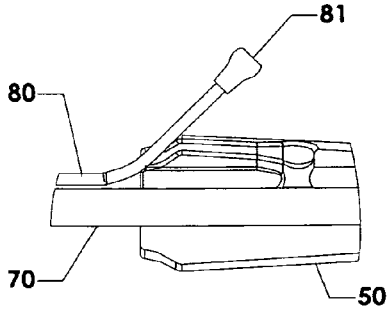
FIG. 19 is a detailed view of the crimped end of a line and the seating in the slide.

The handle 60, as shown in FIGS. 15-16, is a rounded in shape to aid the boater in grasping the apparatus, and is secured to the two stainless rods 70 by a pair of screws 66 which are affixed into threaded holes on opposing sides of the handle. As with the fixed guide 40, the handle 60 has mooring line guidance extensions 65 to engage and guide the mooring line. These extensions 65 are curved on their inner sides to create the confined area 64 which helps control the mooring line. The extensions 65 are concave on their outer sides to aid in grasping. There are a pair of rod channels 62 defined in the handle for seating the ends of the rods 70. Also shown are pull line apertures 63 but these have no function in the present invention but accommodate other embodiments of the apparatus.

The rods 70 may be round, square, hexagon, etc. and the tubular sleeves would be appropriate for whatever rod shape. The present invention anticipates round rods as shown herein and while 316 stainless steel is preferred, it is possible that the rods could also be formed from fiberglass or plastics. The advantage of having the rods formed of 316 stainless steel is that the steel can be thinner while still providing greater strength, also there would be less deformation and better connectivity to the hook attachment base 32. If plastic is used, the one benefit of weight may be offset by the necessity of increased diameter and less controlled lengths. While designs of the apparatus 25 could possibly utilize a single rod or three or more rods, dual rods offer the best stability when coordinated with a fixed guide 40 and handle 60. The separation distance of the rods 70 is a variable dictated by the size of the hook attachment base 32. The rods 70 are secured by 1.25 inch truncated screws to the front end 30, and truncated set screws affix them to the fixed guide 40, and handle 60.

The pull lines 80 are preferably made of any material having the strength and capability to handle salt water, controlled elongation under wet conditions. Materials may include rope, aircraft cable, polyvinylchloride coated stainless steel, braided lines, or any line may be substituted providing it can cope with the harsh environment without any elongation problems. Aircraft cable is cited for it has shown excellent controlled elongation under wet conditions. While pull lines 80 are described as a pair of lines, it will be appreciated that the pull line is one continuous line that is wrapped around the movable arm 31*c* therein creating two lines extending from the movable arm, somewhat like a shoelace. The ends of the pull lines 80 are each inserted into a fastener and the fastener then crimped to retain the line therein.

Figure 20:
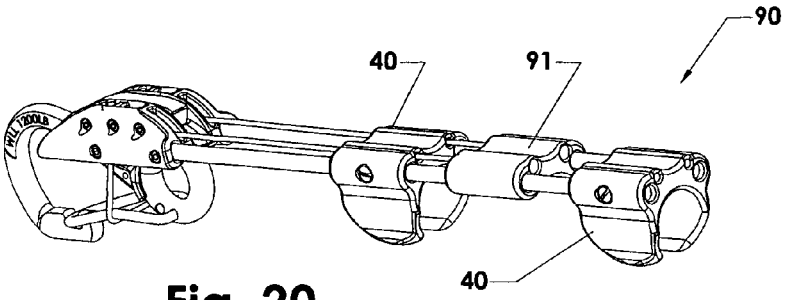
FIG. 20 is top pictorial view of an alternate embodiment of the invention.
Figure 21:
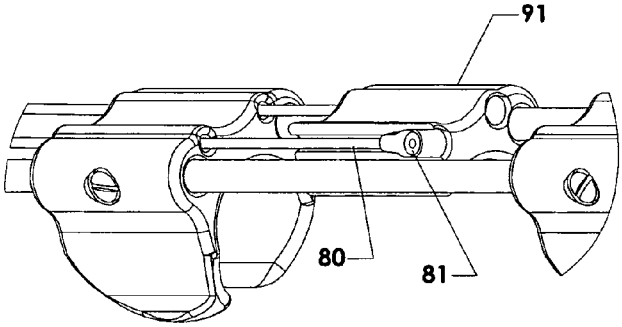
FIG. 21 is a partial pictorial of an alternate slide embodiment and the seating of the crimp end of the pull lines.
Figure 22:
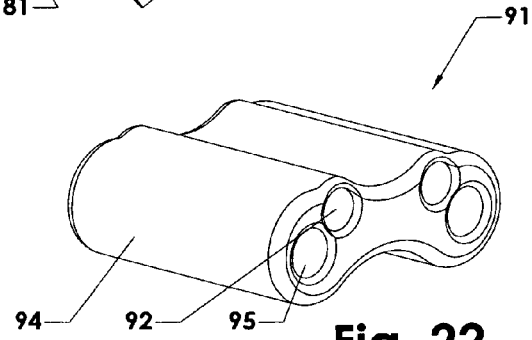
FIG. 22 is a pictorial view of the alternate embodiment slide.
Figure 24:
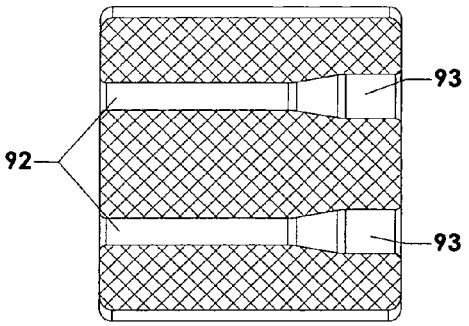
FIG. 24 is a top sectional view of the slide taken along lines B-B.
Figure 23:
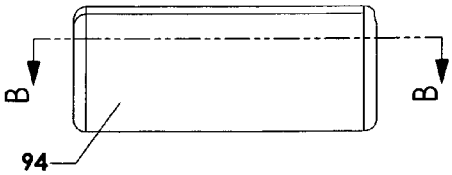
FIG. 23 is an elevated side view of the slide of FIG. 22.

FIG. 20 illustrates how the fixed guide 40 may also be interchangeably used as a handle. Actually, the fixed guide 40 and rounded handle 60 are interchangeable without any deviation from the inventive aspect of the apparatus 25. They each may be used as either a fixed guide or a handle or both.

FIGS. 20-24 show an alternate version of the slide, wherein the pull lines 80 are held within the slide 91 by a slightly different slide geometry. This slide 91 only requires minor modifications of the fixed guide. In this embodiment the line apertures 92 extend through the slide 91 with beveled areas 93 defined in the slide as best seen on FIG. 24, which is a cross-section of the line apertures 92 taken from the side 94 of the slide 91. The crimped fasteners 81 of the lines 80 are securely held within the beveled areas 93. The rod channels 95 are slightly larger in diameter than the rods 70 to allow a free flowing slide 91.

While it is apparent that the illustrated embodiment of the invention herein disclosed fulfill the objectives stated above, it will be appreciated that numerous modifications and other embodiments may be devised by those skilled in the art. Therefore, it will be understood that the appended claims are intended to cover all such modifications and embodiments which come within the spirit and scope of the present invention. It is anticipated that the apparatus has a variety of used outside of watercraft uses.

What is claimed is:

1. A mooring pendant apparatus for use in docking a boat, wherein the apparatus releasably couples or decouples to an eyelet on the brow or to a buoy, the apparatus comprises:

an attachment front end including: a hook; a hook attachment base having a pair of pull line apertures and a pair of rod channels defined therein; the hook having a backbone for affixing to the hook attachment base, a movable arm for opening and closing of the hook, a grasping end for receiving the movable arm, and a ring section having an opening for tying a mooring line; and a wedge securing the hook attachment base to the hook;

a pair of rods;

a pair of pull lines, each pull line having a fastener crimped over its distal end;

a fixed guide having a pair of mooring line guidance extensions extending downward to define an opening for passage of a mooring line, a pair of rod channels for guiding each of the rods, and a pair of pull line apertures for guiding each of the pull lines, wherein the fixed guide is attached to the rods;

a slide having a pair of rod channels defined through its body with each channel sized to allow a sliding relationship with each rod, and a pair line apertures defined through the slide, and a means for securing the pull lines in the slide; and a handle with a rounded construction, each handle having a pair of mooring line guidance extensions defining an opening for passage of a mooring line, a pair of rod channels defined for guiding each of the rods, the handle attached to the rods, wherein, a boater may pull the slide with sufficient force to overcome the locking tensions place on the movable arm, therein causing the hook to open.

2. The apparatus of claim 1, wherein the wedge is secured to the hook attachment base by six 1.00 inch truncated screws, each screw having a partially unthreaded smooth shank, three screws on each opposing side of the hook attachment base, and each rod is secured to the hook attachment base by two 1.25 inch truncated screws, each having a partially unthreaded smooth shank.

3. The apparatus of claim 2, wherein the pull lines travel through a path in the hook attachment base, the path a result of each pull line passing under the partially unthreaded smooth surface of one of the 1.00 inch truncated screws, then passing over the smooth surface of the next adjoining 1.00 inch truncated screw, and then gliding by a partially unthreaded smooth surface of one of the 1.25 inch truncated screws, and then wrapping around the movable arm of the hook.

4. The apparatus of claim 1, wherein the means for securing the pull lines in the slide comprises a pair of canals defined in an upper surface of the slide, each canal having a beveled area defined at its distal end wherein the boater securely fastens the lines by placing the crimped end of each line fit into one of the beveled areas.

5. The apparatus of claim 1, wherein the pull lines are formed from wire, aircraft cable, polyvinylchloride coated stainless steel, braided, or monofilaments, or any suitable material that is compatible with a marine environment.

6. The apparatus of claim 1, wherein the rods are formed out of 316 stainless steel, brass, or a thermoplastic material.

7. The apparatus of claim 1, wherein the rods may be round, square, hexagon or other shape.

8. The apparatus of claim 1, wherein the hook attachment base, wedge, fixed guide, slide and handle are formed from a thermoplastic.

9. The apparatus of claim 1, wherein the hook attachment base, wedge, fixed guide, slide and handle are formed from a corrosion resistant metal.

10. The apparatus of claim 1, wherein the fixed guide and the handle are attached to the rods by truncated set screws.

11. The apparatus of claim 1, wherein the fixed guide and the handle have a pair of curved mooring line guidance extensions defining a constricted area for retention of the mooring line.

12. The apparatus of claim 1, wherein each of the fixed guide and handle are interchangeable, and each may be used in either position.

13. The apparatus of claim 1, wherein the means for securing the pull lines in the slide comprises a pair of beveled areas defined in the distal ends of the line apertures, the beveled areas of a size and shape to securely hold the crimped fasteners of the pull lines.

* * * * *